United States Patent [19]

Macuka

[11] 4,171,585

[45] Oct. 23, 1979

[54] ROLL DISPLAY DEVICE

[76] Inventor: Slavoljub E. Macuka, 3445 avenue Laval, Montreal, Quebec, Canada, H2X 3C7

[21] Appl. No.: 869,313

[22] Filed: Jan. 13, 1978

[51] Int. Cl.[2] ..... G09F 7/18

[52] U.S. Cl. ..... 40/518; 40/155; 40/603

[58] Field of Search ..... 40/518, 603, 155, 519–523

[56] References Cited

U.S. PATENT DOCUMENTS

| | | | |
|---|---|---|---|
| Re. 26,156 | 2/1967 | Muller | 160/24 |
| 314,405 | 3/1885 | Whipple | 40/518 |
| 394,856 | 12/1888 | Hendrick | 248/448 |
| 435,696 | 9/1890 | Hoffmann | 40/603 |
| 577,530 | 2/1897 | Lee | 40/155 X |
| 620,777 | 3/1899 | Hoskin | 40/518 |
| 879,261 | 2/1908 | Harter | 40/518 |
| 1,236,355 | 8/1917 | Ratto | 248/462 |
| 1,396,553 | 11/1921 | Bovy | 40/518 |
| 1,467,896 | 9/1923 | Juvet | 40/155 |
| 1,699,176 | 1/1929 | Zaremba | 248/448 |
| 1,840,620 | 1/1932 | Dennis | 248/462 |
| 2,140,674 | 12/1938 | Hassett | 248/448 |
| 2,330,777 | 9/1943 | Elliott | 248/451 |
| 2,479,812 | 8/1949 | Cechmanek | 160/24 |
| 2,588,803 | 3/1952 | Coffey | 40/364 |
| 2,720,718 | 10/1955 | Vaniman | 40/603 |
| 2,832,172 | 4/1958 | Shelp | 248/443 |
| 3,228,455 | 1/1966 | Jacobson | 160/24 |
| 3,367,050 | 2/1968 | Doyle | 40/362 |
| 3,543,425 | 12/1970 | Mulvey | 40/518 |

FOREIGN PATENT DOCUMENTS

| | | | |
|---|---|---|---|
| 20249 | 4/1930 | Australia | 40/518 |
| 71573 | 5/1901 | Canada | 40/518 |
| 863137 | 1/1953 | Fed. Rep. of Germany | 40/518 |
| 22654 | of 1915 | United Kingdom | 40/518 |
| 603483 | 6/1948 | United Kingdom | 40/518 |

*Primary Examiner*—John F. Pitrelli

*Attorney, Agent, or Firm*—Schwartz, Jeffery, Schwaab, Mack, Blumenthal & Koch

[57] ABSTRACT

A roll display device having a pair of roll mounting cylinders, an expandable frame rotatably mounting the cylinders at the ends of the frame and a base support for the frame. Each mounting cylinder has means for quickly clamping a roll end on it. Means are provided for rotating each mounting cylinder to wind or unwind a roll on or off it thus moving the roll, in either direction across the frame.

9 Claims, 10 Drawing Figures

ROLL DISPLAY DEVICE

The present invention relates to an improved roll display device and, more particularly, to an improved roll display device of the type displaying a portion of a rolled-up map, blueprint, or similar article.

Roll display devices of the above type are known as shown, for example, in U.S. Pat. No. 1,467,896 issued Sept. 11, 1923. O. Jovet inventor. This type of roll display device permits a large, rolled-up map or blueprint to be mechanically held in a partly unrolled position, particularly outdoors, so that a portion of it can be readily viewed. The display device frees the viewer's hands for other jobs and eliminates the awkward manual job of trying to hold a rolled-up map or blueprint, particularly in a wind, in a partly unrolled position. The display device is particularly useful since it employs an expandable frame which permits the display device to be stored in a small space. The expandable frame can be adjusted in length when being used so that larger or smaller portions of the roll can be viewed as desired.

The known devices have disadvantages however. They cannot accommodate long rolls since no means are provided at each end of the expandable frame of the device for receiving rolled-up ends of the roll. Also, no means are provided at either, or both ends of the frame for mechanically rolling up or unrolling the roll so that it can be easily moved in either direction across the frame for viewing. Further, no means are provided for self-supporting the frame in a manner so it can be adjusted to a variety of viewing positions.

It is therefore an object of the present invention to provide a roll display device having an expandable frame which can receive rolled-up ends of a roll at both ends of the frame. This permits very long rolls to be displayed.

It is another object of the invention to provide a roll display device with means for rolling or unrolling a roll end at each end of the frame so that the roll to be displayed can be easily moved in either direction across the frame for viewing.

It is a further object of the invention to provide a support stand for the display device which includes means for adjusting the viewing position of the roll.

It is still another object of the present invention to provide means for easily and positively attaching the ends of a roll on rotatable roll support members at each end of the frame.

These objects are achieved with a roll display device comprising a pair of cylindrical roll mounting members, a longitudinally expandable frame having a lattice-work structure which frame carries the mounting members on its ends in substantially parallel rotation and a base support for the frame.

The base support comprises means for mounting the frame at its center on the base support for rotational movement about two mutually perpendicular axes.

Means are provided for attaching an end of the roll onto each mounting member. Each attaching means comprise a part cylindrical cover, means for hinging the cover to the mounting member and means for clamping the cover flush against the mounting member with a roll end between the cover and the mounting member.

Means are also provided for rotatably mounting each mounting member on the frame. Each mounting means comprise a support member for connecting each mounting member to an end of the frame and a pair of axles carried at the ends of each support members for rotatably mounting the mounting member therebetween.

Preferably, the device according to the present invention includes means for rotating each mounting member on its axle.

The invention will now be further understood with reference to the following description of an embodiment taken in connection with the accompanying drawings in which.

Figure 1:
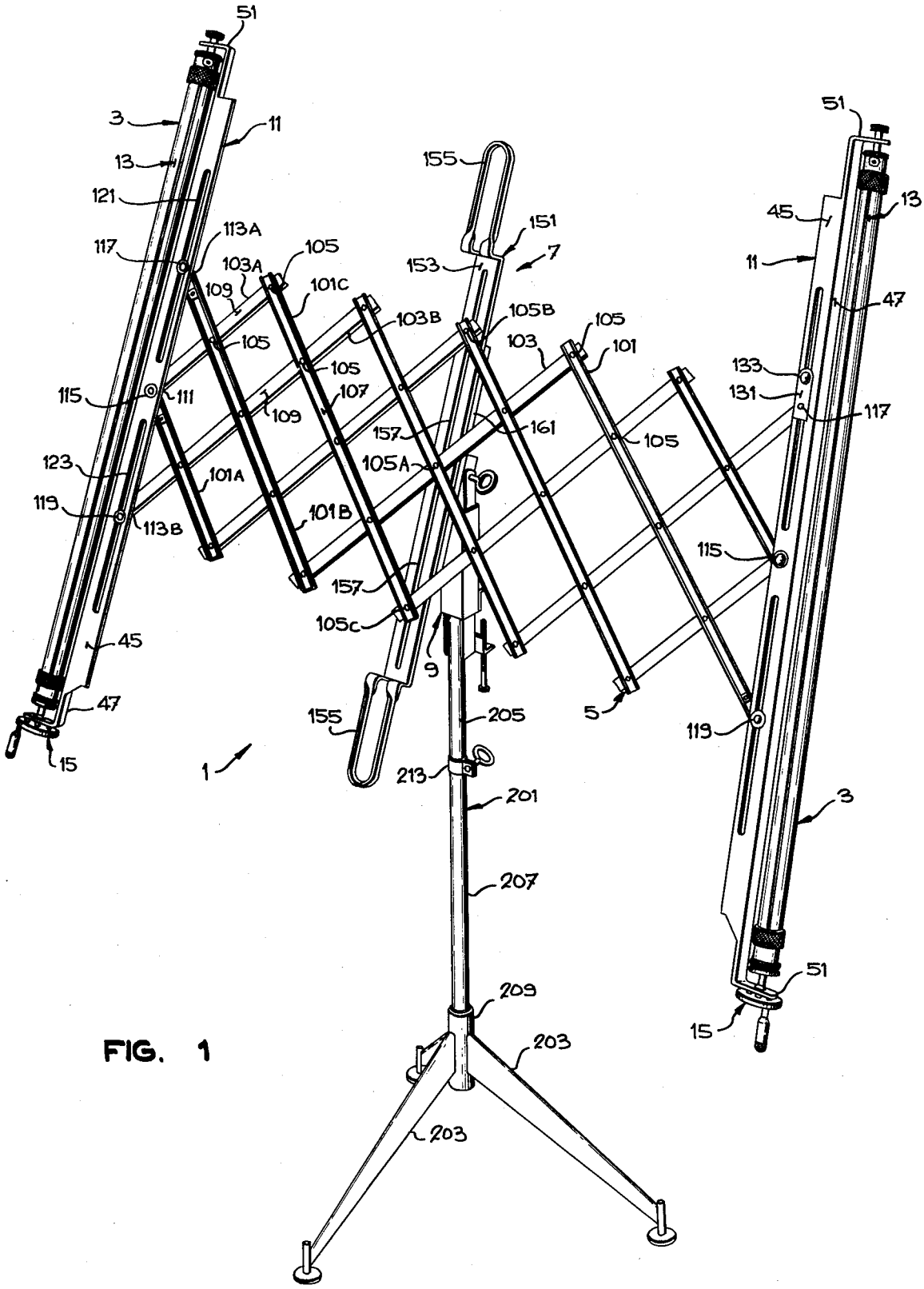
FIG. 1 is a perspective view of a roll display device according to the invention.

The roll display device 1 shown in FIG. 1, includes a pair of roll mounting members 3 carried by a frame 5. The frame 5 is extendable and is mounted at its approximate center to a frame support 7 which in turn is pivotably mounted to a display stand base 9. The roll mounting members 3 are each mounted to an end of frame 5 by a mounting support 11. The frame 5 maintains the roll mounting members 3 in substantially parallel position at all times regardless of whether the frame is extended or collapsed.

Each roll mounting member 3 includes means 13 for fastening an end of a roll "R" thereto. The roll is wound, by winding means 15, onto each mounting member 3 until the portion of the roll extending between the mounting members 3 and lying on top of the frame 5 is tight. The roll can then be moved across the frame 5, in either direction, by winding it up on one mounting member while simultaneously unwinding it off the other mounting member.

Figure 4:
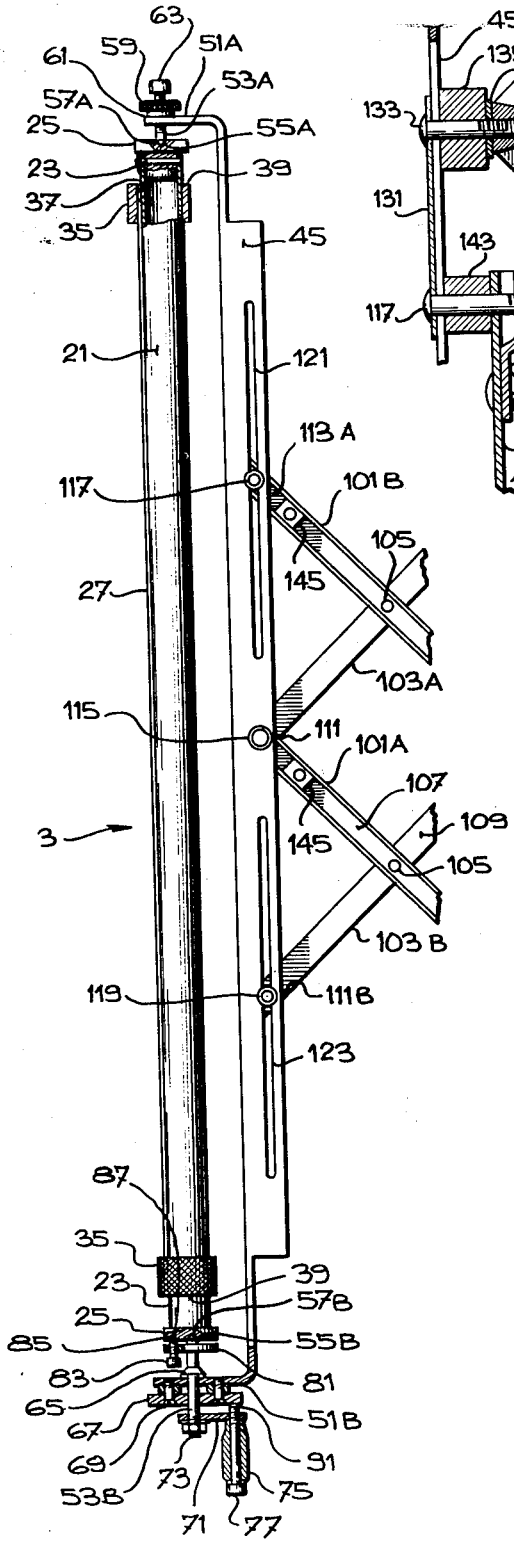
FIG. 4 is a front detail view of one roll holder.
Figure 6:
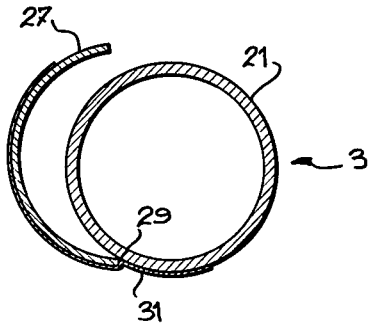
FIG. 6 is a cross-sectional view of one roll holder ready to receive one end of a roll.

Referring to FIGS. 4 and 6, each mounting member 3 comprises a cylindrical member 21 which is preferably tubular. Each end 23 of the cylindrical tube 21 is closed by a cap 25 which fits tightly into the end of the tube 21. Each tube 21 has a part cylindrical cover 27 extending over a major portion of its length. The cover 27 is hinged along one edge 29 to the tube 21 by a flexible hinge 31 which can extend the length of the cover 27. The hinge 31 is fastened to the outer surfaces of the tube 21 and cover 27 by suitable means and is substantially parallel to the axis of tube 21. The cover 27 is concentric to tube 21 when closed thereon and covers approximately half of the tube.

Means are provided for clamping the cover 27 against the tube 21 to sandwich an end of the roll "R" between said cover 27 and tube 21 when mounting the roll on the tube. These clamping means comprise a clamping ring 35 at each end of tube 21. Each ring 35 has a tapered central bore 37. The small end of the bore is located at the end 39 of the ring 35 which is nearest the cap 25 at each end of the tube 21. When placing the end of the roll "R" under the cover 27, the rings 35 are located on the tube 21 adjacent the caps 25 at each end of the tube, clear of the cover 27. After, the cover 27 is moved to sandwich the roll end between it and tube 21, the rings 35 are moved inwardly from the caps 25 onto the cover 27 at each end to wedge the cover 27 tight against the roll end and the tube 21 and to thus firmly hold the roll end in place. The outer surface of the rings 35 can be scored to provide a good gripping surface when the rings are grasped to be moved between locked and unlocked positions.

Each tube 21 is mounted on each mounting support 11 so that it can rotate about its longitudinal axis. Each mounting support 11 comprises an angle-shaped member having a pair of flanges 45 and 47 perpendicular to each other. One flange 45 is used to connect the support 11 to the frame 5 as will be described. The other flange 47 has an extension from each end which is bent at right angles part way along its length to provide supports 51 for mounting the tube 21. The supports 51 are substantially parallel and the tube 21 is mounted between the supports 51 parallel to the flanges 45 and 47. A short axle 53 is mounted perpendicularly in each support 51. The axles 53 extend toward each other and both have pointed ends 55. The pointed ends 55 of the axles 53 fit in corresponding conical depressions 57 formed in the center of the caps 25 closing the ends 23 of the tube 21. The upper axle 53A as shown in FIG. 4, is movably mounted in support 51A. For this purpose, a portion of axle 53A is threaded, and this threaded portion is screwed through a tapped hole in the support 51A. A locking nut 59 is provided on the threaded portion of the axle 53A which nut screws against the support 51A through a washer 61 adjacent the support 51A, to lock the axle 53A in any desired position. The axle 53A has an enlarged head 63 opposite its pointed end 55A by means of which the axle can be moved relative to the support 51A.

The lower axle 53B is rotatably mounted in the lower support 51B. A washer 65, fixed onto the axle 53B and lying on top of the support 51B limits longitudinally movement of the axle 53B relative to the support 51B. A circular brake pad 67 is mounted on the bottom side of the support 51B with screws 69. The axle 53B passes freely through the center of the pad 67. An arm 71 is fixedly attached at one end to the bottom end 73 of the axle 53B. A handle 75, parallel to the axle 53B, but offset therefrom, is attached to the other end of the arm 71. The handle 75 is fixed to the arm 71 by a bolt 77 threaded through the handle and through a threaded hole in the other end of the arm 71. The bolt 77 which extends through the handle and arm up to the brake pad 67, can be screwed toward or away from the brake pad 67. A circular clutch plate 81 is fixed to the axle 53B adjacent its pointed end 55B. The axle 53B passes through the center of plate 81. A clutch bolt 83 parallel to, but offset from, axle 53B is screwed through a threaded hole in plate 81. The end 85 of bolt 83 is pointed and it fits in a corresponding conical depression 87 in the cap 25, offset from the depression 57B.

To rotatably mount each tube 21 between the axles 53A and 53B, the top axle 53A is moved outwardly away from the axle 53B. Tube 21 is then mounted on the pointed end 55B of the bottom axle 53B, and its upper end is positioned under the pointed end 55A of the top axle 53A. Top axle 53A is then screwed down to move its pointed end 55A into the conical depression 57A in the top cap 25 of tube 21. The tube 21 can now freely rotate about aligned axles 53A and 53B. To positively rotate the tube 21, the clutch bolt 83 is screwed inwardly to place its pointed end 85 in the conical depression 87. When the handle 75 is rotated about the axis of the axle 53B, the axle 53B (via arm 71), the clutch plate 81, the bolt 83 and the tube 21 (via the connection of the bolt 83 to the bottom cap 25) are all rotated. The handle 75 can be rotated in either direction about the axle 53A to wind a roll on or off tube 21. To prevent inadvertent rotation of the tube 21, the brake bolt 77 can be screwed inwardly, in the arm 71, to have its inner end 91 abut the brake pad 67 and thus frictionally "lock" the tube 21 in a desired position.

The expandable frame 5 as shown in FIGS. 1 and 4 comprises a first set of bars 101 crossing and overlying a second set of bars 103 in a lattice-work type structure also known as lazy-tongs structure. Where each bar 101 cross bars 103 it is pivotably connected thereto with a pivot pin 105. The bars 101 and 103 preferably comprise shallow channel members the webs 107 and 109 of which abut.

Each end of the frame 5 is attached to the flange 45 on support 11, as is shown in FIGS. 1 and 4. Each end of the frame 5 is attached at its center 111 and its corners 113A and 113B to the flange 45. The center 111, formed by the ends of two bars 101A and 103A, is pivotably connected with a bolt 115 fixed to the center of flange 45. The top corner 113A, formed by the end of a bar 101B is pivotably connected by a bolt 117 to the flange 45 above the fixed bolt 115. The bottom corner 113B, formed by the end of a bar 103B, is pivotably connected by a bolt 119 to the flange 45 below the fixed bolt 115. Both bolts 117 and 119 are slidably mounted in longitudinal slots 121 and 123 in the flange 45, one slot 121 being above the fixed bolt 115 while the other slot 123 is below the bolt 115. With bolts 117 and 119 slidable in slots 121 and 123, on both ends of the frame, the frame can be expanded or collapsed to provide a mounting area of desired size between the tubes 21 for receiving the portion of roll "R" to be viewed.

Figure 5:
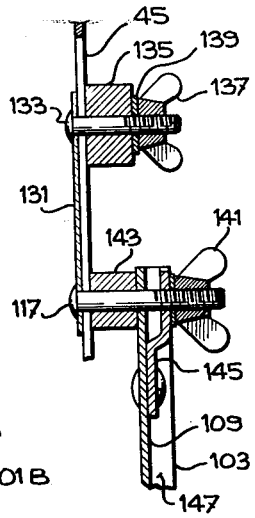
FIG. 5 is a detail view of the frame fastening means on the display device.
Figure 8:
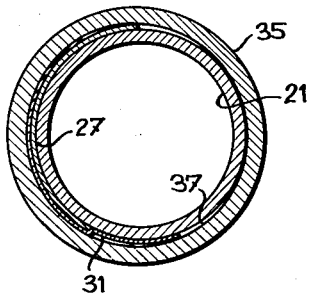
FIG. 8 is a cross-sectional view of the one roll holder locked in roll clamping position.
Figure 7:
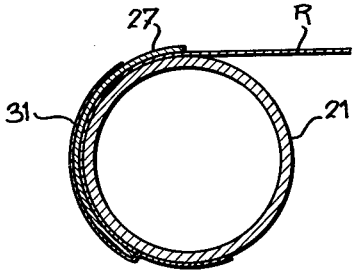
FIG. 7 is a cross-sectional view of the one roll holder clamping one end of a roll.

Means are provided to lock the frame 5 in a desired expanded position. These means, as shown in FIGS. 1 and 5, include a locking plate 131, pivotably connected at one end to one of the corner bolts 117 and pivotably connected at its other end to a locking bolt 133. The plate 131 rides on the flange 45 and the locking bolt 133 passes through the slot 121. The locking bolt 133 passes through a spacer 135 on the back of the flange 45 and a wing nut 137 is threaded onto the bolt 133 against a washer 139 adjacent the spacer 135 which is preferably made of resilient material. When the wing nut 137 is loosened, the bolt 117, and the other bolts 117 and 119 are free to travel in the slots 121 and 123. Thus the frame can be expanded or collapsed. When the wing nut 137 is tightened, the bolts 117 and 119 on both sides of frame 5 cannot move in the slots 121 and 123 and the frame is locked in position.

If desired, the bolts 117 and 119 can be detachably connected to the frame 5 with wing nuts 141 so that the supports 11 can be readily removed. As shown in FIG. 5, a spacer 143 is provided on the bolts 117 and 119 between the flange 45 and bars 101 and 103. A bracket 145 is fixed to the web 107 and 109 of each bar 101 and 103 adjacent each bolt 117 and 119, offset to be level with the flanges 147 of the bars. The bolts 117 and 119 pass through the brackets 145 which act as a spacer for the channel shaped bars 101 and 103.

The frame 5 is fixedly mounted at its center, between its ends, to the frame support 7. The frame support 7 has a support strap 151 with a flat, relatively long, central portion 153 and short offset end portions 155. The top surface of the end portions 155 lie in substantially the same plane as the top surfaces of the flanges 45. The strap end portions 155 serve to support the roll between supports 11. They also serve as handles for positioning the frame 5 relative to its base support, as will be seen hereinafter. The central strap portion 153 has a pair of longitudinal slots 157, one on either side of a central hole (not shown). The central hole receives the central pivot pin 105A of the frame, which pin 105A is slightly longer than the other pins 105 so as to extend through the strap 151. The pin 105A fixed the frame 5 to the strap 151. The central upper and lower pivot pins 105B, 105C extend through the slots 157 in the strap 151 and also serve to fix the frame 5 to the strap 151. Pins 105B and 105C have a length equal to the length of pin 105A. The pins 105B, 105C are free to move in the slots 157 as the frame 5 is expanded or collapsed.

Figure 2:
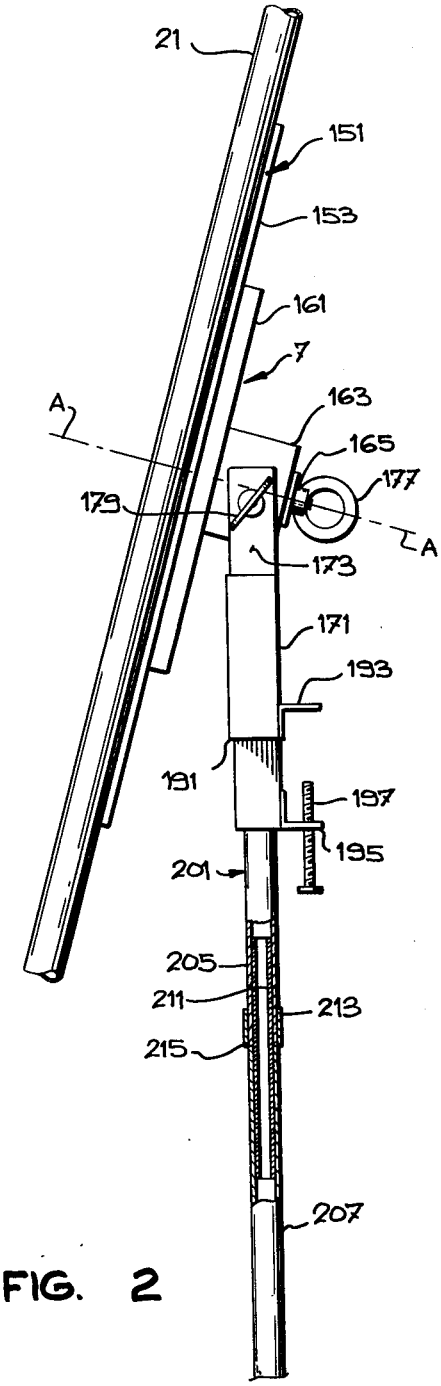
FIG. 2 is a detail side view, in partial section, of the device and its base.
Figure 3:
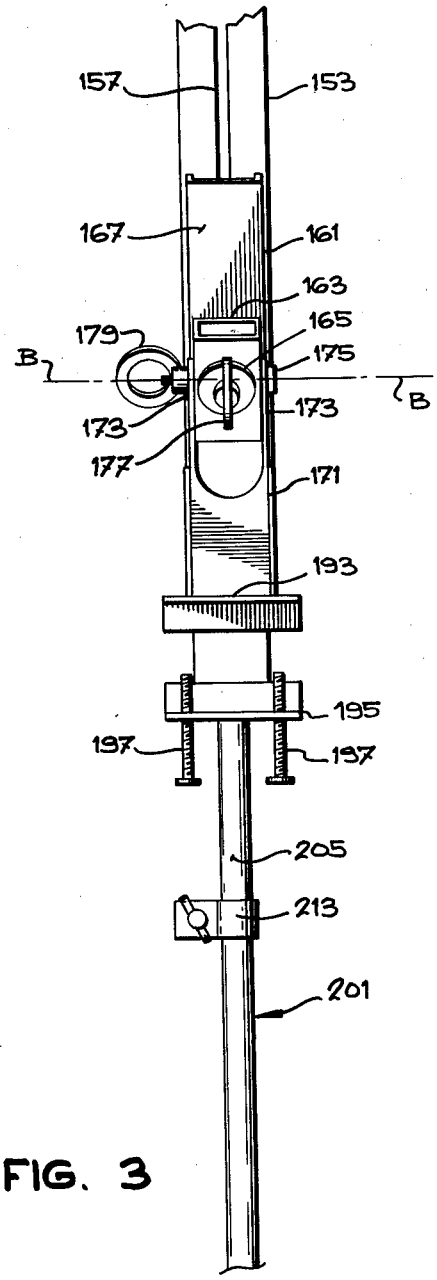
FIG. 3 is a detail rear view of the device base.

The frame support 7 include a central brace in the form of a channel member 161 attached to the back of the central portion 153 of the strap 151 by its flanges as shown in FIGS. 1 to 3. A mounting block 163 is rotatably attached with a bolt 165 to the center of the frame support 7. The block 163 is attached to the back of the channel 161 with the bolt 165 which passes through the web 167 of the channel 161.

The block 163 is also pivotably mounted to the base 9. The base 9 includes a base support 171 having a pair of upstanding ears 173 between which the block 163 is mounted. A bolt 175 pivotably connects the block 163 to the ears 173. The bolt 175 is located just above the bolt 165 and perpendicular to it. Both bolts 165 and 175 have ring nuts 177 and 179 respectively by means of which they can be tightened. The bolt 165, when loosened, permits the frame 5 to be rotated, relative to the base support 171, about a first axis A—A. The bolt 175, when loosened, permits the frame 5 to be rotated, relative to the base support 171, about a second axis B—B which is perpendicular to the axis A—A. Thus the position of the portion of the roll being viewed can be easily adjusted.

The base support 171 includes means at or near its bottom end 191 by which means the support 171 can be clamped onto a fixed support, such as the edge of a desk or table top. The clamping means can comprise a first horizontal clamping bracket 193 fixed to the back of base support 171 above bottom end 191. A second horizontal clamping bracket 195 is fixed to the back of the base support adjacent bottom end 191 under the first bracket 193. A pair of clamping bolts 197 are threaded up through holes in the second bracket 195 toward the first bracket 193. The bolts 197 serve to clamp a table or desk edge against the first bracket 193 to mount the display device 1.

The base 9 also includes a telescoping stand 201 with legs 203 so that the display device 1 may be self-supporting. The telescoping stand 201 comprise a fist tubular member 205 projecting down from the bottom end 191 of base support 171 and a second matching tubular member 207 extending up from a bracket 209 from which the legs 203 extend outwardly and downwardly. A telescoping member 211 is fixedly mounted in the top end of tubular member 207 with a portion projecting up therefrom to telescopically slide into the bottom end of the tubular member 205. A clamp 213 is mounted on first tubular member 205 at its bottom end 215. When the clamp 213 is loosened, the first tubular member 205, and the attached frame 5, can be moved along telescoping member 211, to adjust the height of the display stand 1. The clamp 213 is tightened to lock the stand at the desired height.

Figure 9:
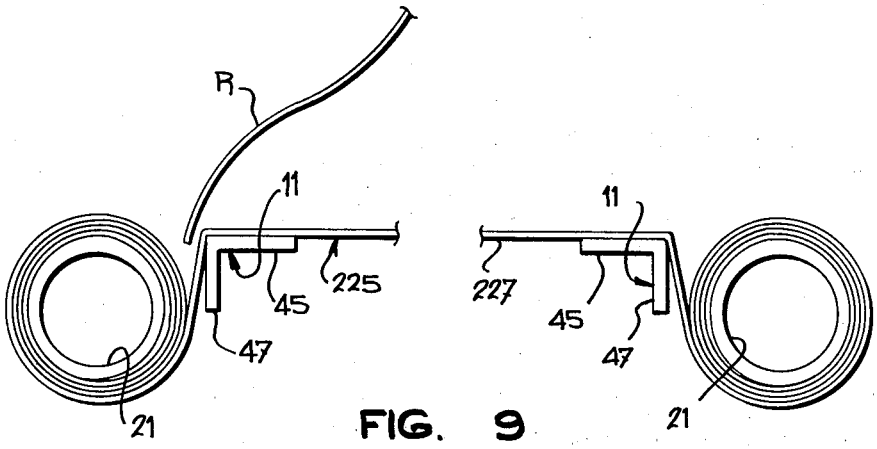
FIG. 9 is a plan view of the display device carrying a backing roll.
Figure 10:
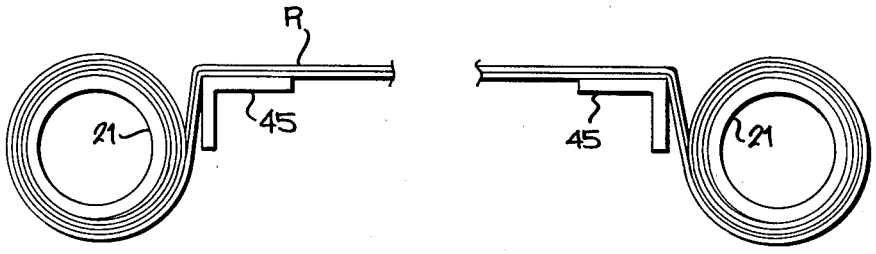
FIG. 10 is a view similar to FIG. 9 showing the use of the backing roll.

If desired, the display device 1 can be provided with flexible backing means 225. The flexible backing means 225 as shown in FIGS. 9 and 10 comprises a film 227 of plastic material which is wound on tubes 21 and stretched between them across the frame 5. The roll "R" is then placed on the film 227 and wound on the rolls. The film 227 serves both as a backing light-shade for the roll, which is often necessary when using blue prints or the like, and as a backing layer providing some material support so that the roll can be written or marked on if desired.

I claim:

1. A roll display device comprising:

a pair of cylindrical roll mounting members;

an expandable frame having a lattice-work structure for carrying said mounting members in substantially parallel relation, said frame having upper, lower, left and right sides and comprising a first set of at least three bars pivotably connected by pins to a second, crossing set of at least three bars, said first and second sets of bars being symmetrical and so arranged that the frame comprises a central pivot pin, two upper and two lower ends and four pivot pins centrally located between the upper and lower ends on the upper, lower, left and right sides of the frame, respectively;

a pair of mounting means for rotatably mounting the mounting members onto the frame, each of said mounting means comprising a support member for connecting one of said mounting members to the frame and a pair of axles carried at the ends of the support member for rotatably mounting said one mounting member therebetween, said support members being respectively fixed at a point approximately midway between the ends thereof to pivot pins on the frame and being held parallel to each other by means of the upper and lower ends of the frame slidably mounted thereon;

a base, said base comprising:

(a) a frame support to which the frame is fixedly mounted by the central pivot pin, said frame support including a support strap having a relatively long, central portion extending parallel to the mounting members, for slidably receiving and guiding the upper and lower pivot pins of the frame;

(b) a mounting block to which is rotatably attached the frame support about an axis passing through the central pivot pin, and (c) a fixing base to which is rotatably attached the mounting block about a horizontal axis; and means for attaching the ends of the roll onto the mounting members.

2. A device as claimed in claim 1, wherein said attaching means each comprises a part cylindrical cover, means for hinging the cover to the mounting member, and means for clamping the cover flush against the mounting member with a roll between the cover and mounting member.

3. A device as claimed in claim 1, wherein one axle is mounted on the support member to be movable toward or away from the other axle.

4. A device as claimed in claim 1, including means for rotating each mounting member on its axles, said rotating means comprising means for selectively connecting one axle to the mounting member and handle means for rotating the one axle, and thus rotating the selectively connected mounting means.

5. A device as claimed in claim 4 including brake means for preventing the mounting members from inadvertently rotating.

6. A device as claimed in claim 5 wherein the brake means comprises a brake pad mounted about the one axle, and means on the handle means for selectively, frictionally abutting the brake pad.

7. A device as claimed in claim 1 wherein the base support includes a telescopic stand.

8. A device as claimed in claim 1 wherein the base support includes means for clamping it to a fixed support.

9. A device as claimed in claim 1 including a flexible backing member extending between the mounting members and over the frame to support the portion of a roll mounted between the mounting members.

* * * * *